United States Patent [19]

Gould

[11] Patent Number: 4,732,091

[45] Date of Patent: Mar. 22, 1988

[54] PYROLYSIS AND COMBUSTION PROCESS AND SYSTEM

[75] Inventor: Orval E. Gould, Mission Viejo, Calif.

[73] Assignee: G.G.C., Inc., Santa Ana, Calif.

[21] Appl. No.: 781,465

[22] Filed: Sep. 30, 1985

[51] Int. Cl.[4] ..... F23G 5/027; F23G 5/16

[52] U.S. Cl. ..... 110/229; 110/248; 110/256; 110/259; 110/345; 110/346; 48/76; 48/111

[58] Field of Search ..... 48/76, 111, 194, 203, 48/209, 66, 68; 423/213.2, 230; 110/225, 256, 346, 347, 345, 229, 230, 248, 256, 259, 287, 289; 60/39.12, 39.18 B, 39.41, 39.47

[56] References Cited

U.S. PATENT DOCUMENTS

| | | | |
|---|---|---|---|
| 2,772,945 | 12/1956 | Dunning et al. | 423/230 |
| 3,511,194 | 5/1970 | Stookey | 48/111 |
| 3,729,298 | 4/1973 | Anderson | 48/111 |
| 3,759,036 | 9/1973 | White | 48/209 |
| 3,759,677 | 9/1973 | White | 48/209 |
| 3,820,964 | 6/1974 | Janka | 48/209 |
| 4,005,994 | 2/1977 | Feldmann | 48/111 |
| 4,052,173 | 10/1977 | Schulz | 48/209 |
| 4,152,122 | 5/1979 | Feldmann | 48/111 |
| 4,201,141 | 5/1980 | Teodorescu et al. | 110/259 |
| 4,230,602 | 10/1980 | Bowen et al. | 48/209 |
| 4,452,154 | 6/1984 | Kono et al. | 110/256 |
| 4,530,702 | 7/1985 | Fetters et al. | 48/203 |
| 4,635,573 | 1/1987 | Santen | 110/346 |

*Primary Examiner*—David L. Lacey

*Attorney, Agent, or Firm*—Max Geldin

[57] ABSTRACT

A process which comprises the steps of introducing combustible solid material into an upper section of a pyrolysis chamber, moving the material downwardly at a controlled rate through multiple stage zones in the pyrolysis chamber, passing hot gaseous products of the partial oxidation of carbon char upwardly countercurrent to the movement of the solid material in the pyrolysis chamber, driving off volatile matter in the solid material, depositing carbon char in the lower section of the pyrolysis chamber, introducing air into the lower section of the pyrolysis chamber and partially oxidizing the char to form the hot gaseous products, removing a hot overhead fuel gas, passing the overhead fuel gas to a combustion chamber for combustion thereof with air, and applying the resulting hot combustion gases exiting the combustion chamber to a heat load. Where the combusible solid material contains one or more acid components, the process also includes the step of passing the overhead fuel gas to a zone containing a chemical adsorbent. An apparatus for carrying out the above process comprises a pyrolysis chamber, a feed-lock system for introducing a combustible solid feed material into an upper section of the chamber, a series of spaced vertically disposed horizontally moveble grates in the chamber, an air inlet into the lower section of the pyrolysis chamber, ash removal apparatus in the bottom of the chamber, a combustion chamber for the overhead fuel gas, and a heat load to which the resulting hot combustion gas is applied.

24 Claims, 2 Drawing Figures

PYROLYSIS AND COMBUSTION PROCESS AND SYSTEM

BACKGROUND OF THE INVENTION

This invention relates to pyrolysis of combustible solid material, and is particularly concerned with a process and system for efficiently pyrolyzing and then burning combustible solid material such as waste, e.g., industrial waste, for conversion of such solid material to heat, e.g. for driving a turbine or other heat load. The term "waste" as employed herein is intended to include, but is not limited to, industrial and household refuse, agricultural waste, feed lot and animal waste, unconventional fuels, biomass, and the like.

Industrial solid waste can be in the form of a combustible solid material of varying composition. A substantial proportion of such industrial waste can be primarily of a cellulosic nature such as scrap paper, cardboard, and the like. Other types of combustible industrial waste, such as for example rubber truck and automobile tires can contain acid components such as sulfur and chlorine.

Various processes have been developed heretofore for conversion of such combustible solid material, e.g. in the form of industrial waste, to heat for producing energy. Such processes include pyrolysis of the combustible solid material to form a fuel gas containing carbon monoxide, and the combustion of such fuel gas to produce hot combustion gases for application to a heat load such as a turbine.

However, such prior art processes and systems suffer largely from being inefficient and uneconomical.

Further, where the combustible solid material such as industrial waste, e.g. in the form of automobile tires, contains acid components such as chlorine and sulfur, the resulting raw fuel gases from pyrolysis, containing such acid components present problems in connection with the further processing of such fuel gases.

Thus, if raw fuel gases containing unsaturated hydrocarbon components are cooled down, some condensation occurs and not only does the condensate polymerize and plug up the lines, but the energy in the fuel gases can be lost. Also, the acid components will be divided between the liquid and vapor phases, requiring two separate treatment processes for removal of acid components.

On the other hand, if the fuel gas were to be treated for removal of acid components after combustion, as common in present practice, there is a much greater mass of gas to be treated following combustion, and this substantially increases the expanse of the process.

One object of the present invention is the provision of an efficient and economical method and system for producing energy from combustible solid material, particularly waste material.

Another object is to provide a process for the controlled pyrolysis of pyrolyzable feed material to produce a fuel gas, affording flexibility to handle various feed material compositions, particularly derived from industrial waste.

A still further object of the invention is the provision of an efficient process for the pyrolysis of combustible solid material, particularly waste material which can contain acid components such as sulfur and chlorine, and cleaning the resultant hot fuel gas containing such acid components prior to combustion of the fuel gas, to avoid the above noted problems of the prior art practice.

SUMMARY OF THE INVENTION

The above objects and advantages of the invention are achieved according to two main features. One important feature of the invention is the provision of a counterflow, multistage pyrolysis procedure and system, and a second important feature is the provision of a procedure and system for removal of pollutants and acid components or gases from the resultant hot fuel gas overhead from the pyrolysis reactor, at formation temperature in vapor phase on a chemical adsorbent.

Combustible solid material such as industrial waste, which may be essentially carbonaceous, and which may or may not contain acid components, is introduced into the upper section of a pyrolysis chamber. The solid material moves downwardly at a controlled rate through multiple stage zones in the pyrolysis chamber, which can be provided according to one preferred embodiment, by a series of moveable grates.

Hot gases, which are the products of partial oxidation of carbon char, occurring at the bottom of the pyrolysis chamber, pass upwardly in the pyrolysis chamber countercurrent to the downward movement of the solid material in the chamber. The moveable grates or other actuators which can be employed, tend to keep the solid material moving uniformly downwardly countercurrent to the upflow of the hot gases in the chamber. The rate of downward movement of the solid feed through each stage is such that equilibrium is substantially achieved in each stage in the pyrolysis reaction between the solid combustible feed and the upwardly flowing hot combustion gases.

These hot gases drive off all volatile matter in the solid feed material and such volatile matter exits as overhead from the pyrolysis chamber in admixture with the gaseous products of the partial oxidation of the char. The resulting solid material from which the volatile matter was driven off, deposits as carbon char in the lower section or bottom of the pyrolysis chamber. Air or oxygen in introduced into the lower section of the pyrolysis chamber into contact with the carbon char therein, partially oxidizing the char to form hot gaseous products, which can comprise hydrocarbons, carbon monoxide and hydrogen. Such hot gaseous products then flow upwardly in the pyrolysis chamber into contact with the downwardly moving solid feed material, as described above. Ash and other non-combustible material is removed from the bottom of the pyrolysis chamber. Prior to such removal the ash and non-combustible material can be quenched.

The raw fuel gas which is removed as overhead and which can comprise hydrocarbons, carbon monoxide, hydrogen and nitrogen, is at a controlled elevated temperature, e.g. about 800° F. to about 1,000° F. The temperature of the overhead gas is controlled by controlling the flow rate of air into the carbon char for partial oxidation thereof.

If an excess of carbon char is deposited in the bottom of the pyrolysis chamber and temperature of the overhead is within a satisfactory temperature range, steam may be introduced into the carbon char, resulting in the water gas reaction forming carbon monoxide and hydrogen.

If acid components such as sulfur or chlorine are present in the solid feed material, the overhead gas from the pyrolysis chamber can be cleaned to remove such acid components and pollutants by contact in the hot vapor phase with a suitable chemical adsorbent. Such chemical adsorbent can be in the form of a bed, e.g. of calcium carbonate. The hot fuel gas exiting the pyrolysis chamber, or exiting the treatment zone containing chemical adsorbent where the pyrolysis gas contains acid components, is subjected to combustion, in air, and the resultant hot combustion gases are applied to a heat load, e.g. in the form of a turbine.

The invention thus provides an efficient multi-stage equilibrium pyrolysis process and system for the controlled pyrolysis of pyrolyzable feed material, and in addition, the invention affords the additional feature of providing flexibility as by suitable chemical treatment of the hot fuel gas overhead with chemical reagents, for handling various feed material compositions which may contain undesirable pollutants or acid components.

BRIEF DESCRIPTION OF THE DRAWINGS

A better understanding of the invention may be had by reference to the following description, taken in conjunction with the accompanying drawings in which.

DETAILED DESCRIPTION OF THE INVENTION AND PREFERRED EMBODIMENTS

Figure 1:
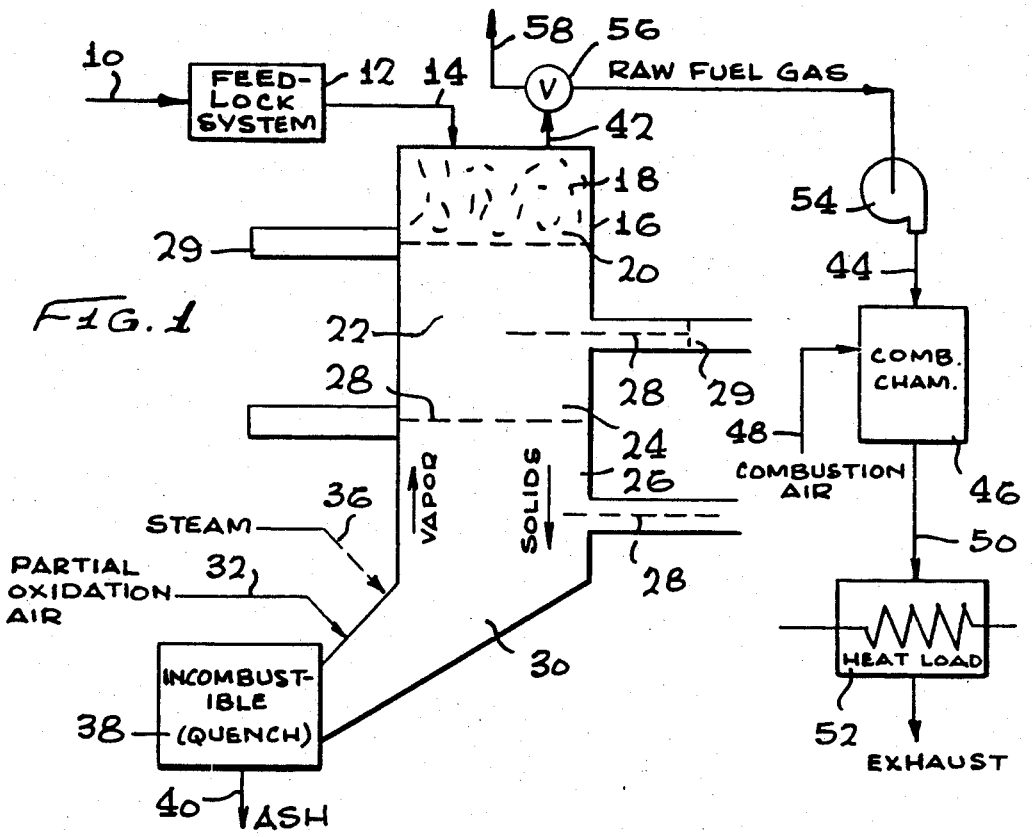
FIG. 1 is a schematic flow sheet of the pyrolysis process of the invention for pyrolysis and burning of combustible solid material for the production of energy.

Referring to FIG. 1 of the drawing, combustible solid material such as industrial waste is first prepared as by shredding, for use as a feed material in the invention process. Such industrial waste can vary in composition and is preferably primarily a cellulosic material such as scrap paper, cardboard, wood chips, and the like.

The raw material or prepared refuse, indicated at 10 is first introduced into a feed-lock system at 12 for suitable feeding the raw material at 14 into the top of a pyrolyzer or pyrolysis chamber 16. The feed-lock system 12 is of any conventional type which prevents backflow of gases from the top of the pyrolyzer.

The solid raw material 18 introduced into the pyrolyzer moves downward therein from the upper section of the pyrolysis chamber through four separate stages 20, 22, 24 and 26, in countercurrent flow to hot combustion gases passing upwardly in the pyrolyzer, and which are the products of partial oxidation of carbon char, occurring in the bottom of the pyrolysis chamber, as further described below.

In the downward movement of the feed material in the pyrolyzer 16, such material passes over a plurality of spaced grates 28 which are vertically disposed and horizontally moveable within the pyrolysis chamber 16, by means of actuators indicated generally at 29, such grates forming the above noted four vertically positioned stages within the pyrolyzer. The moveable grates 28 tend to keep the solid combustible material 18 moving uniformly downwardly in the pyrolyzer at a controlled rate, and preventing plugging of the pyrolyzer while permitting uniform upward flow of hot gas through the downwardly moving solid mass, without channeling or formation of vapor pockets in the feed material, and achieving substantial reaction equilibrium at each stage, in the pyrolysis reaction.

Alternatively, in place of moveable grates, other moveable means can be used to provide controlled downward movement of the solid material in the pyrolysis chamber, for example a cylindrical column with a tray and wiper which moves the solid material to a weir over which the solid material flows for further downward movement. Other apparatus which performs the same function also can be employed.

In the pyrolysis chamber, which may have a temperature ranging from 2800° F. at the bottom to 800° F. at the top, the hot combustion gases passing upwardly from the bottom of the pyrolysis chamber and in contact with the solid combustible material passing countercurrently downward, drives off the volatile matter in the solid material and pyrolyzing it to carbon char which deposits at the bottom of the pyrolysis chamber. Thus, as the hot gases move upwardly all of the volatile materials in the raw feed material, which can include hydrocarbons such as methane and heavier hydrocarbons, are vaporized from the incoming material.

The solid product of the pyrolysis reaction deposits in the lower section or bottom 30 of the pyrolysis chamber. Air or oxygen is introduced at 32 into the char in the bottom of the pyrolysis chamber, which partially oxidizes the carbon char so that the resulting hot gases are comprised of a mixture of carbon monoxide (CO), hydrogen and nitrogen. The overhead which exits the top of the pyrolysis chamber at 42 thus consists of a mixture of the hot partial oxidation combustion gases, together with the volatile gases given off from the solid feed material, and comprising a mixture of hydrocarbons of varying molecular weights ranging from methane to decane, carbon monoxide, hydrogen and nitrogen. The raw fuel gas which thus exits the top of the pyrolyzer can have a temperature ranging, for example, from about 800° F. to about 1,000° F.

The partial oxidation air introduced at 32 in the bottom of the pyrolysis chamber is controlled on the basis of the temperature of the overhead fuel gas. If an excess of carbon char is present at the bottom of the pyrolyzer and the temperature of the overhead fuel gas is in the proper temperature range, as noted above, steam may be added at 36 to the carbon char, resulting in the water gas reaction and forming C and hydrogen.

Ash and other non-combustible material resulting from the partial oxidation of the carbon char in the bottom of the pyrolysis chamber is quenched at 38 by introducing water, and the resulting quenched material is then removed at 40 from the bottom of the pyrolysis chamber.

The raw hot fuel gas overhead at 42 from the top of the pyrolysis chamber is then introduced at 44 into a combustion chamber 46 of any suitable type and the hot fuel gas therein is then subjected to combustion by the introduction at 48 of excess air or oxygen into the combustion chamber.

The resulting hot combustion gases exiting the combustion chamber at 50, and at a temperature of about 1,600° F. to about 1,700° F., is introduced into a heat load, indicated at 52, which can be in the form of a down-fired gas turbine, a boiler or other heat load.

A blower 54 is provided at a suitable point in the system, for example between the pyrolysis chamber 16 and the combustion chamber 46, to maintain a slight negative pressure in the pyrolysis reactor, to prevent leakage of noxious vapors. Where a source of compressed air is available an ejector alternatively can be employed for this purpose.

If desired, the fuel gas overhead 42 from the pyrolysis chamber can pass through a diverter valve 56 which can operate on hydraulic pressure so that if the pressure of the overhead fuel gas at 42 becomes excessive due to a malfunction or failure in the system, the fuel gas can be diverted at 58, and can be stored or burned.

Figure 2:
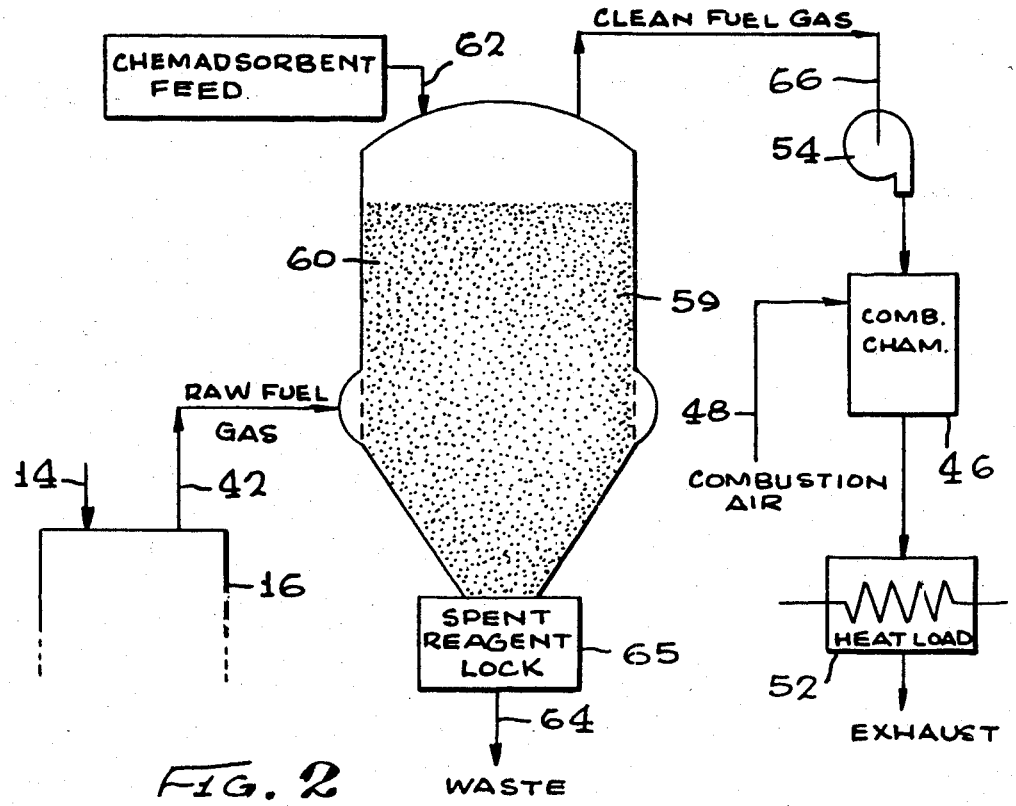
FIG. 2 is a flow sheet illustrating a process and system according to the invention for the pyrolysis and burning of combustible solid material to provide energy, showing additional treatment of the overhead fuel gas from the pyrolysis zone with a chemical adsorbent, prior to combustion of the fuel gas.

Now referring to FIG. 2 of the drawing, the system shown therein is employed according to the invention, where the raw feed material consists essentially of a cellulose material and contains pollutants, e.g. in the form of one or more acid constituents such as sulfur and chlorine, as for example industrial waste in the form of scrap truck and automobile tires, which can contain acid components such as sulfur and chlorine. As previously noted, cooling of the fuel gas from the pyrolysis chamber prior to treatment thereof for removal of pollutants and acid components, can result in disadvantageous condensation of the fuel gas, or if the hot gases following combustion are treated for removal of pollutants and acid components, as heretofore practiced, this is disadvantageous because the resulting gas mass to be treated can be of the order of 15 times greater than the mass of the hot fuel gas before combustion. Thus, as shown in FIG. 2, according to the present invention, the raw overhead fuel gas at 42 from the pyrolysis chamber 16 is cleaned by introducing same into a bed of a chemical adsorbent 59 in an adsorbent chamber 60, into which the chemical adsorbent is introduced at 62. The chemical adsorbent can be calcium carbonate, or any other acid adsorbent such as bentonite or sodium carbonate.

The bed of chemical adsorbent can be in the form of a continuous feed system, with spent reagent removed at 64 from the bottom of the treating chamber 60, via a spent reagent lock at 65, or in the form of a dual stationary bed system (not shown).

The resultant clean fuel gas at a temperature of about 800° to about 1,000° F. is then passed at 66, and via the blower 54, into the combustion chamber 46. The resulting hot combustion gases are then applied to a heat load 52, as described above.

The following is an example of practice of the present invention:

According to the invention process and system as illustrated in FIG. 1 and described above, combustible shredded waste is processed utilizing about 50 tons per day, which produces on the average 4,500 Btu per pound, of energy.

The bottom of the pyrolysis chamber operates at a temperature of about 2,800° F., with an input of about 180 moles per hour of air at 800° F. into the bottom of the pyrolyzer.

Overhead combustible gas at a temperature of about 1,000° F. exits the top of the pyrolyzer in an amount of about 275 moles per hour. The combustible gas is introduced into an ejector, into which is also introduced air at 4 atmospheres pressure and 1,400° F. in an amount of 20 moles per hour. The ejector maintains a slight negative pressure in the pyrolysis chamber.

The raw hot fuel gas exiting the ejector and at a slight positive pressure is introduced into a combustion chamber. Combustion air at 800° F. and in an amount of about 3,400 moles per hour is fed to the combustion chamber.

Hot combustion gases at a temperature of 1,600° F. exit the combustion chamber and are passed to a heat exchanger, to extract about 18 million Btu per hour of energy.

From the foregoing, it is seen that the invention provides an efficient counterflow, multiple-stage pyrolysis process and system for conversion of combustible solid material to a hot fuel gas, and also provides a process and system for removal of pollutants and acid gases from the hot fuel gas by chemical adsorption on a solid reagent. The process and system of the invention successfully pyrolyzes and then burns combustible solid material, particularly industrial waste, in a manner which provides the highest efficiency, is extremely simple to control and can make environmentally acceptable.

Since various changes and modifications of the invention will occur to and can be made readily by those skilled in the art without departing from the invention concept, the invention is not to be taken as limited except by the scope of the appended claims.

What is claimed is:

1. A process for pyrolysis and combustion of combustible solid material which comprises:

introducing combustible solid feed material containing volatile matter into an upper section of a pyrolysis chamber having a lower section and a bottom, moving said material downwardly at a controlled rate through multiple stage zones in said pyrolysis chamber, said multiple stage zones being provided by a series of spaced vertically disposed horizontally moveable grates in said pyrolysis chamber, depositing carbon char in the lower section of the pyrolysis chamber, introducing air into the lower section of said pyrolysis chamber and partially oxidizing said char to form hot gaseous products, passing said hot gaseous products of the partial oxidation of said carbon char upwardly countercurrent to the movement of said solid material in said pyrolysis chamber, and driving off said volatile matter in said solid material in a multistage equilibrium process, wherein substantial reaction equilibrium is achieved in each of said stage zones in the pyrolysis chamber between the solid combustible feed material and said upwardly passing hot gaseous products, removing ash and other non-combustible material from the bottom of said chamber, removing a hot overhead fuel gas comprised of said volatile matter from the solid material and the hot gaseous products of the partial oxidation of the carbon char, passing said overhead fuel gas to a combustion chamber for combustion thereof with air, subjecting said overhead fuel gas to combustion in said combustion chamber, and applying the resulting hot combustion gases exiting the combustion chamber to a heat load.

2. The process of claim 1, including passing said combustible solid material through a feed-lock system prior to the introduction of said solid material into said pyrolysis chamber.

3. The process of claim 1, including controlling the temperature of the overhead gas by controlling the flow rate of air for the partial oxidation of said char.

4. The process of claim 1, including depositing an excess of said carbon char in the lower section of said pyrolysis chamber and introducing steam into said excess carbon char to carry out a water gas reaction, and forming $CO_2$ and $H_2$.

5. The process of claim 1, wherein said combustible solid material contains one or more acid components, and including passing the overhead fuel gas containing said components to a zone containing a chemical adsorbent for the acid components, and recoving a clean hot fuel gas substantially free of said acid components, for passage to said combustion chamber.

6. The process of claim 5, wherein said combustible solid material is a combustible solid industrial waste comprising essentially a cellulosic material containing an acid component selected from the group consisting of S and Cl, which results in said overhead fuel gas comprising hydrocarbons, CO, $H_2$, $N_2$ and said acid component.

7. The process of claim 1, wherein said combustible solid material is a combustible solid industrial waste comprises essentially of cellulosic material, which results in said fuel gas comprising hydrocarbons, CO, $H_2$ and $N_2$.

8. The process of claim 7, wherein the hot overhead fuel gas has a temperature ranging from about 800° F. to about 1,000° F., and said hot combustion gases exiting the combustion chamber having a temperature ranging from about 1,600° F. to about 1,700° F.

9. The process of claim 1, including quenching the ash and other non-combustible material in the bottom of said pyrolysis chamber prior to removal thereof.

10. A process for pyrolysis and combustion of combustible solid material which comprises:

introducing combustible solid feed material derived from industrail waster and comprises essentially of carbonaceous material including volatile hydrocarbons, through a feed-lock system, introducing said solid material exiting said feed-lock system into an upper section of a pyrolysis chamber having a lower section and a bottom, moving said solid material downwardly in a plurality of successive vertically disposed stages in said pyrolysis chamber at a controlled rate, said vertically disposed stages being provided by a series of horizontally moveable vertically spaced grates in said pyrolysis chamber, depositing carbon char in the lower section of the pyrolysis chamber, flowing air into the carbon char in the lower section of said pyrolysis chamber and partially oxidizing said char to form hot gases containing C, $H_2$ and $N_2$, passing said hot gases upwardly countercurrent to the downward movement of said solid material in said pyrolysis chamber, driving off said volatile hydrocarbons from said solid carbonaceous material and pyrolyzing it to form said carbon char, in a multistage equilibrium process, the rate of downward movement of the combustible solid material in the pyrolysis chamber in relation to the upward flow of the hot gases being such as to achieve substantial reaction equilibrium in each of said stages in the pyrolysis chamber between the solid combustible feed material and said upwardly passing hot gaseous products, removing a mixture of said volatile hydrocarbons and said hot gases as an overhead hot fuel gas from the upper section of said pyrolysis chamber, the overhead hot fuel gas being maintained in a predetermined temperature range by controlling the flow rate of air into the carbon char, quenching ash and other non-combustible material resulting from the partial oxidation of said char and removing same from the bottom of said pyrolysis chamber, introducing said hot overhead fuel gas into a combustion zone for combustion therein with an excess of oxygen, subjectng said overhead fuel gas to combustion in said combustion zone, and passing the resulting hot combustion gases to a heat load.

11. The process of claim 10, wherein the hot overhead fuel gas has a temperature ranging from about 800° F. to about 1,000° F.

12. The process of claim 10, said combustible solid material containing an acid component selected from the group consisting of S and Cl, which results in said overhead fuel gas comprising hydrocarbons, CO, $H_2$, $N_2$ and said acid component, and including passing the overhead fuel gas containing said acid component to a zone containing a bed of chemical adsorbent, and recovering a clean hot fuel gas substantially free of said acid component, for passage to said combustion zone.

13. The process of claim 12, said chemical adsorbent being calcium carbonate.

14. The process of claim 10, including maintaining a slight negative pressure in the pyrolysis chamber to prevent leakage of noxious vapors therefrom.

15. The process of claim 10, including depositing an excess of said carbon char in the lower section of said pyrolysis chamber and introducing steam into said excess carbon char to carry out a water gas reaction, and forming CO and $H_2$.

16. The process of claim 10, including selectively diverting the overhead fuel gas to storage.

17. A process for pyrolysis and combustion of combustible solid material which comprises:

introducing combustible solid material containing volatile matter into an upper section of a pyrolysis chamber having a lower section and a bottom, moving said material at a controlled rate downwardly through multiple stage zones in said pyrolysis chamber, said multiple stage zones being provided by a series of spaced vertically disposed horizontally moveable grates in said pyrolysis chamber, depositing carbon char in the lower section of the pyrolysis chamber, introducing air into the lower section of said pyrolysis chamber and partially oxidizing said char to form hot gaseous products, passing said hot gaseous products of the partial oxidation of said carbon char upwardly countercurrent to the movement of said solid material in said pyrolysis chamber, and driving off said volatile matter in said solid material in a multistage equilibrium process, wherein substantial reaction equilibrium is achieved in each of said stage zones in the pyrolysis chamber between the solid combustible feed material and said upwardly passing hot gaseous products, removing ash and other non-combustible material from the bottom of said chamber, and removing a hot overhead fuel gas comprised of said volatile matter from the solid material and the hot gaseous products of the partial oxidation of the carbon char.

18. A system for pyrolysis and combustion of combustible solid material which comprises:

a pyrolysis chamber having an upper section, a lower section and a bottom, means for introducing a combustible solid feed material containing volatile matter into said upper section of said pyrolysis chamber, means comprising a series of spaced vertically disposed horizontally moveable grates forming a plurality of stage zones in said pyrolysis chamber and permitting downward movement of the solid material at a controlled rate through said zones, means for introducing air into the lower section of said pyrolysis chamber for contact with carbon char which will be deposited therein from the solid material, for partially oxidizing the carbon char, and forming hot gaseous products passing upwardly countercurrent to the movement of the solid matreial in said pyrolysis chamber and driving off volatile matter in the material by a multistage equilibrium operation, wherein substantial reaction equilibrium is achieved in each of said stage zones in the pyrolysis chamber between the solid combustible feed material and the upwardly passing hot gaseous products, means for removing ash and other non-combustible material from the bottom of said chamber, means for removing a hot overhead fuel gas from said pyrolysis chamber, a combustion chamber, means for introducing the overhead fuel gas into said combustion chamber, means for introducing air into said combustion chamber for combustion of the fuel gas therein, a heat load, and means for applying the resulting combustion gases to said heat load.

19. The system of claim 18, wherein said means for introducing the solid feed material includes a feed-lock system for receiving the combustible solid material prior to introduction thereof into said pyrolysis chamber.

20. The system of claim 18, including a chemical adsorbent treatment zone, and means for introducing the overhead fuel gas from said pyrolysis chamber first into said chemical adsorbent treatment zone prior to introducing the overhead fuel gas into said combustion chamber.

21. The system of claim 18, including means for introducing steam into the lower section of said pyrolysis chamber to contact carbon in order to carry out a water gas reaction.

22. The system of claim 18, including means for quenching ash and other non-combustible material in the bottom of said pyrolysis chamber prior to removal thereof.

23. The system of claim 18, including means for maintaining a slight negative pressure in the pyrolysis chamber to prevent leakage of noxious vapors therein.

24. The system of claim 18, including means for selectively diverting overhead fuel gas away from the combustion chamber.

* * * * *